United States Patent [19]

Ravn

[11] 4,110,926

[45] Sep. 5, 1978

[54] CHANGEABLE EXHIBITOR COMPRISING A VIDEO OR SCRIPT TAPE MOVABLE IN A CLOSED LOOP

[75] Inventor: Børge Andreas Ravn, Copenhagen, Denmark

[73] Assignee: Moviefig APS, Copenhagen, Denmark

[21] Appl. No.: 738,396

[22] Filed: Nov. 3, 1976

[51] Int. Cl.[2] ..... G09F 19/00

[52] U.S. Cl. ..... 40/485; 40/525

[58] Field of Search ..... 40/51, 48, 43, 96.5, 40/96, 32; 74/88, 37

[56] References Cited

FOREIGN PATENT DOCUMENTS

| | | | |
|---|---|---|---|
| 190,603 | 12/1922 | United Kingdom | 40/51 |
| 191,225 | 1/1923 | United Kingdom | 40/51 |
| 176,049 | 2/1922 | United Kingdom | 40/51 |

*Primary Examiner*—John F. Pitrelli
*Assistant Examiner*—G. Lee Skillington

[57] ABSTRACT

A changeable exhibitor comprising a video or script tape movable on vertical guide rollers in a closed loop, a weighted roller freely movable along a substantially horizontal roller path within the interior space of said loop, a disc on one side of the roller, and projections on the side of the tape facing the roller path, said disc and projections cooperating to advance the tape in response to movement of the weighted roller in one direction along the roller path.

2 Claims, 3 Drawing Figures

CHANGEABLE EXHIBITOR COMPRISING A VIDEO OR SCRIPT TAPE MOVABLE IN A CLOSED LOOP

This invention relates to a changeable exhibitor provided with a video or script tape which is movable in a closed loop. Such a movable tape can be used for instance for advertising or as eye catcher on a vehicle.

It is the object of the invention to ensure the advancing of the tape in a predetermined direction by means of forces generated by the acceleration and deceleration of the vehicle.

This object has been accomplished by a changeable exhibitor wherein the tape, which is controlled by vertical guide rollers, encloses a substantially horizontal roller path for a weighted roller with a spindle of which at least one end is adapted for or provided with means for unilateral cooperation with projections on the side of the tape facing the roller path for advancing the tape in response to movement of the weighted roller in one direction along the roller path. The forces generated by the acceleration and deceleration of the vehicle actuate the weighted roller and cause it to move forwards and backwards along the roller path. During these movements the means provided at one side of the weighted roller cooperate with the projections on the tape to advance it in response to movement of the weighted roller in one direction, but not in response to movement of the roller in the other direction. If the spindle of the weighted roller is provided with the said means at both ends movement of the weighted roller in both directions can be utilized for advancing the tape unilaterally in the predetermined direction.

In a preferred embodiment of the means provided on the weighted roller for cooperating with the tape projections is a circular cylindrical disc coaxial with the spindle of the weighted roller.

Figure 1:
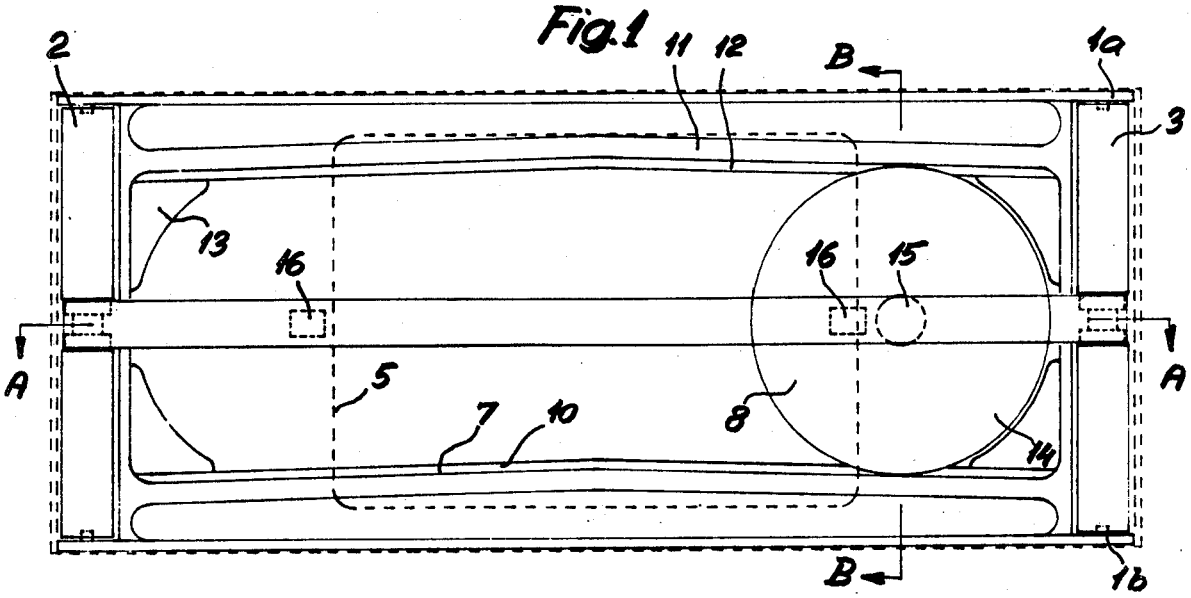
Figure 2:
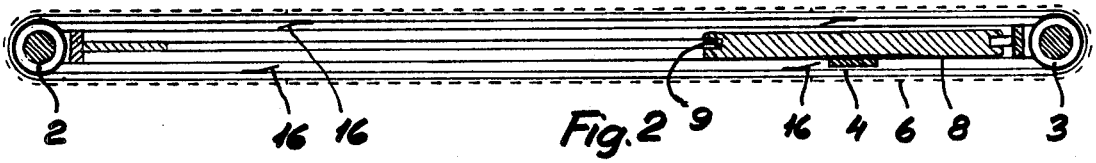
Figure 3:
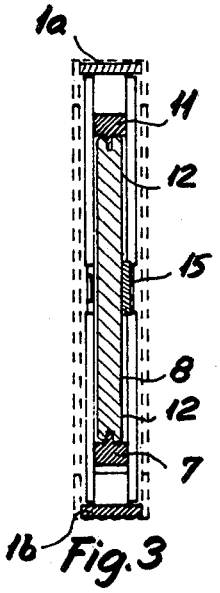

The invention will be described in greater detail below with reference to the drawing, in which FIG. 1 shows a changeable exhibitor according to the invention viewed in side elevation, FIG. 2 presents a section along the line A—A in FIG. 1 and FIG. 3 a section along the line B—B in FIG. 1.

The projector comprises an elongated vertical stationary frame with a horizontal upper frame section 1a and a horizontal lower frame section 1b between which two parallel vertical guide rollers 2, 3 are journalled rotatably in respective ends of the frame. A video or script tape 4, which forms a closed loop, is held distended by the guide rollers 2, 3. The video on script tape 4 is visible from without through a window 5 (FIG. 1) in a casing 6 enclosing the changeable exhibitor.

The frame further comprises a substantially horizontal roller path 7 for a circular cylindrical weighted roller with a horizontal spindle disposed perpendicular to the distended video or script face of the tape 4. The weighted roller 8 is a relatively narrow vertical disc with a guide track or groove 9 along the periphery. The roller path 7 is provided with a spring 10 fitting in the groove 9. The frame also comprises a guide rail 11 extending parallel to the roller path 7 above the weighted roller 8 and likwise provided with a spring 12 fitting in the groove 9. The roller path 7 and the guide rail 11 are spaced by a distance corresponding to the diameter of the weighted roller 8 and thus retain the weighted roller 8 in the frame so as to enable it to roll along the roller path from one end to the other and back. At the ends of the roller path the frame is provided with end stops 13, 14, preferably of rubber and likewise provided with or formed as springs fitting in the groove 9. The end stops 13, 14, are of circular shape of the same curvature as the weighted roller 8 and in the end positions of the weighted roller they engage the periphery of the weighted roller 8.

On one side of the spindle of the weighted roller 8 is provided a circular disc 15 coaxial with the spindle and on the side of the tape 4 facing the roller path 7 and level with the disc 15 is provided a row of projections 16 in the closed loop. The projections 16 are formed as leaf springs one end of which is secured to the tape 4 and the free end of which is rearwardly inclined relatively to the desired advancing direction of the tape, so that on the movement of the weighted roller 8 in one direction (towards left in FIGS. 1 and 2) they will engage the disc 15, whereby the tape 4 will be drawn towards left. On the movement of the weighted roller 8 in the opposite direction the disc 15 will then slide past the projections 16 without carrying the tape 4 along in the movement. A disc corresponding to the disc 16 might be disposed on the opposite side of the weighted roller 8, which would then cause the tape to be advanced in the same direction in response to movement of the weighted roller 8 in either direction.

When the described changeable exhibitor is mounted with the elongated shape of the frame extending longitudinally of the vehicle the accelerations and decelerations of the vehicle will cause the weighted roller to reciprocate in the frame and thereby cause the video or script tape to perform its unidirectional movement. If the changeable exhibitor is mounted transversely of the longitudinal direction of the vehicle, oscillating motion will produce the desired movement. To prevent any tendency of the weighted roller 8 to stop in the middle of the roller path 7 the path is slightly curved so that both ends are slightly lower than the centre of the roller path 7.

What I claim is:

1. In a changeable exhibitor comprising a video or script tape movable on vertical guide rollers in a closed loop and being controlled by a means of a weighted roller in the interior space of said loop, wherein said weighted roller is freely movable on a substantially horizontal roller path, a member is provided on at least one side of said weighted roller, and projections are provided on the side of the tape facing the roller path, said member having direct unilateral cooperation with said projections for advancing the tape in response to movement of the weighted roller in one direction along the roller path.

2. In a changeable exhibitor according to claim 1, wherein said member is a circular cylindrical disc coaxial with the axis of the weighted roller.

* * * * *